US009196972B2

(12) United States Patent
Todo et al.

(10) Patent No.: US 9,196,972 B2
(45) Date of Patent: Nov. 24, 2015

(54) CRIMP TERMINAL AND CONNECTOR

(71) Applicant: JAPAN AVIATION ELECTRONICS INDUSTRY, LIMITED, Shibuya-ku, Tokyo (JP)

(72) Inventors: Nobuhisa Todo, Tokyo (JP); Takaichi Teramoto, Tokyo (JP); Hiroki Yokohama, Tokyo (JP); Kazuomi Sato, Tokyo (JP); Hiroshi Akimoto, Tokyo (JP); Kiyohito Koide, Tokyo (JP); Takashi Ookawa, Tokyo (JP); Akira Ohno, Tokyo (JP)

(73) Assignee: JAPAN AVIATION ELECTRONICS INDUSTRY, LIMITED, Shibuya-Ku, Tokyo (JP)

( * ) Notice: Subject to any disclaimer, the term of this patent is extended or adjusted under 35 U.S.C. 154(b) by 0 days.

(21) Appl. No.: 14/509,933

(22) Filed: Oct. 8, 2014

(65) Prior Publication Data

US 2015/0147923 A1 May 28, 2015

(30) Foreign Application Priority Data

Nov. 28, 2013 (JP) ..... 2013-246191

(51) Int. Cl.
*H01R 4/18* (2006.01)
*H01R 4/62* (2006.01)

(52) U.S. Cl.
CPC . *H01R 4/188* (2013.01); *H01R 4/62* (2013.01)

(58) Field of Classification Search
CPC ..... H01R 4/18; H01R 4/188; H01R 13/03
USPC ..... 439/882
See application file for complete search history.

(56) References Cited

U.S. PATENT DOCUMENTS

| | | | | |
|---|---|---|---|---|
| 5,316,506 | A * | 5/1994 | Ito | 439/879 |
| 7,722,416 | B2 * | 5/2010 | Gump et al. | 439/879 |
| 8,425,266 | B2 | 4/2013 | Ono et al. | |
| 8,430,700 | B2 | 4/2013 | Ono et al. | |
| 2013/0130566 | A1 | 5/2013 | Onuma et al. | |

FOREIGN PATENT DOCUMENTS

| | | | |
|---|---|---|---|
| JP | 2009181714 | A | 8/2009 |
| JP | 2010198789 | A | 9/2010 |

(Continued)

*Primary Examiner* — Amy Cohen Johnson
*Assistant Examiner* — Oscar C Jimenez
(74) *Attorney, Agent, or Firm* — Holtz, Holtz, Goodman & Chick PC

(57) ABSTRACT

A crimp terminal includes a crimp barrel to be crimped around a conductive core of a cable. The crimp barrel includes an inner surface which is formed with a plurality of cavities independent of one another. Each of the cavities has a predetermined shape in a plane perpendicular to a depth direction of the cavity. The predetermined shape contains a plurality of straight-line segments. Every one of the straight-line segments of the predetermined shape is not parallel with remaining ones of the straight-line segments of the predetermined shape. The straight-line segments of the predetermined shape includes at least one pair of the straight-line segments, which are closest to each other among the straight-line segments of the predetermined shape and are arranged to make an interior angle less than 90 degrees or, if not intersecting each other, are arranged on two straight lines, respectively, wherein the two straight lines make an interior angle less than 90 degrees.

10 Claims, 6 Drawing Sheets

(56) References Cited

FOREIGN PATENT DOCUMENTS

| | | | |
|---|---|---|---|
| JP | 2011081911 | A | 4/2011 |
| JP | 2012009178 | A | 1/2012 |
| JP | 2012038453 | A | 2/2012 |
| JP | 4979147 | B2 | 7/2012 |

* cited by examiner

CRIMP TERMINAL AND CONNECTOR

CROSS REFERENCE TO RELATED APPLICATIONS

An applicant claims priority under 35 U.S.C. §119 of Japanese Patent Application No. JP2013-246191 filed Nov. 28, 2013.

BACKGROUND OF THE INVENTION

This invention relates to a crimp terminal and relates to a connector including the crimp terminal.

Because a conductive core of a cable made of aluminum or aluminum alloy is likely to be oxidized, a crimp terminal to be connected to a conductive core of this kind is formed with serrations to break oxide films formed on the conductive core. For example, JPB 4979147 or JPA 2012-38453 discloses a crimp terminal with serrations. With reference to FIGS. 12 and 13, each of the crimp terminals of JPB 4979147 and JPA 2012-38453 includes a crimp barrel, an inner surface of which is formed with a plurality of cavities as serrations. As shown in FIG. 12, each cavity of serration of JPB 4979147 has a shape of parallelogram in a plane perpendicular to a depth direction of the cavity. As shown in FIG. 13, each cavity of serration of JPA 2012-38453 has a circular shape in a plane perpendicular to a depth direction of the cavity.

The crimp terminal of JPB 4979147 might have a problem that the conductive core is partially moved after crimping. If the conductive core be partially moved so that a gap occurs between the conductive core and the crimp terminal, the conductive core is formed with oxide films, again, which inhibit suitable electrical connection. The crimp terminal of JPA 2012-38453 has another problem that it is difficult to form a stamping die for use in shaping of serrations, resulting in increase of fabrication cost.

SUMMARY OF THE INVENTION

It is therefore an object of the present invention to provide a crimp terminal which has a structure that can establish a stable electrical connection and that makes it easy to form a stamping die for use in shaping of serrations. In addition, it is another object of the present invention to provide a connector which includes the above-mentioned crimp terminal.

One aspect of the present invention provides a crimp terminal which includes a crimp barrel to be crimped around a conductive core of a cable. The crimp barrel includes an inner surface which is formed with a plurality of cavities independent of one another. Each of the cavities has a predetermined shape in a plane perpendicular to a depth direction of the cavity. The predetermined shape contains a plurality of straight-line segments. Every one of the straight-line segments of the predetermined shape is not parallel with remaining ones of the straight-line segments of the predetermined shape. The straight-line segments of the predetermined shape includes at least one pair of the straight-line segments, which are closest to each other among the straight-line segments of the predetermined shape and are arranged to make an interior angle less than 90 degrees or, if not intersecting each other, are arranged on two straight lines, respectively, the two straight lines making an interior angle less than 90 degrees.

Another aspect of the present invention provides a connector which comprises the above-described crimp terminal and a holder holding the crimp terminal.

Since the predetermined shape of each cavity as serration contains the straight-line segments, it is easy to form a stamping die for use in shaping the cavity. Therefore, the crimp terminal according to one aspect of the present invention has no problem that JPA 2012-38453 has in cost.

If straight-line segments parallel to each other be included in the predetermined shape, a conductive core might be partially moved along the straight-line segments. On the contrary, since the predetermined shape according to one aspect of the present invention does not include such parallel line-segments, the crimped conductive core is hardly moved. Thus, in comparison with the crimp terminal of JPB 4979147, the crimp terminal according to one aspect of the present invention can provide more stable electrical connection.

An appreciation of the objectives of the present invention and a more complete understanding of its structure may be had by studying the following description of the preferred embodiment and by referring to the accompanying drawings.

Figure 1:
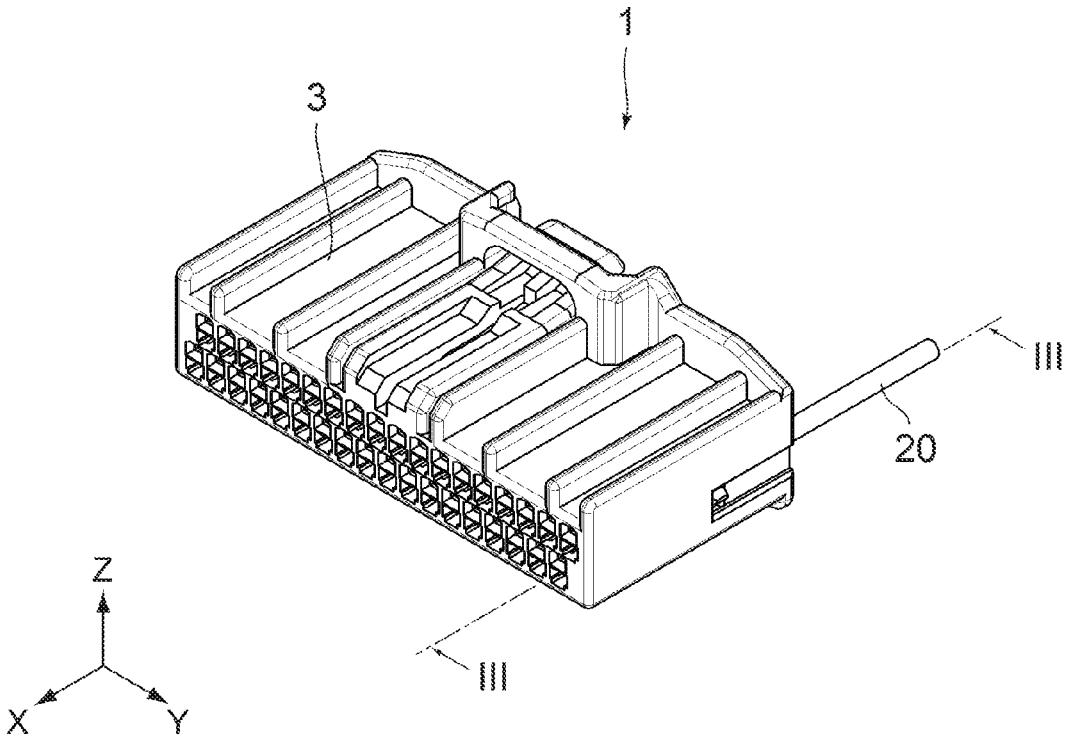
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
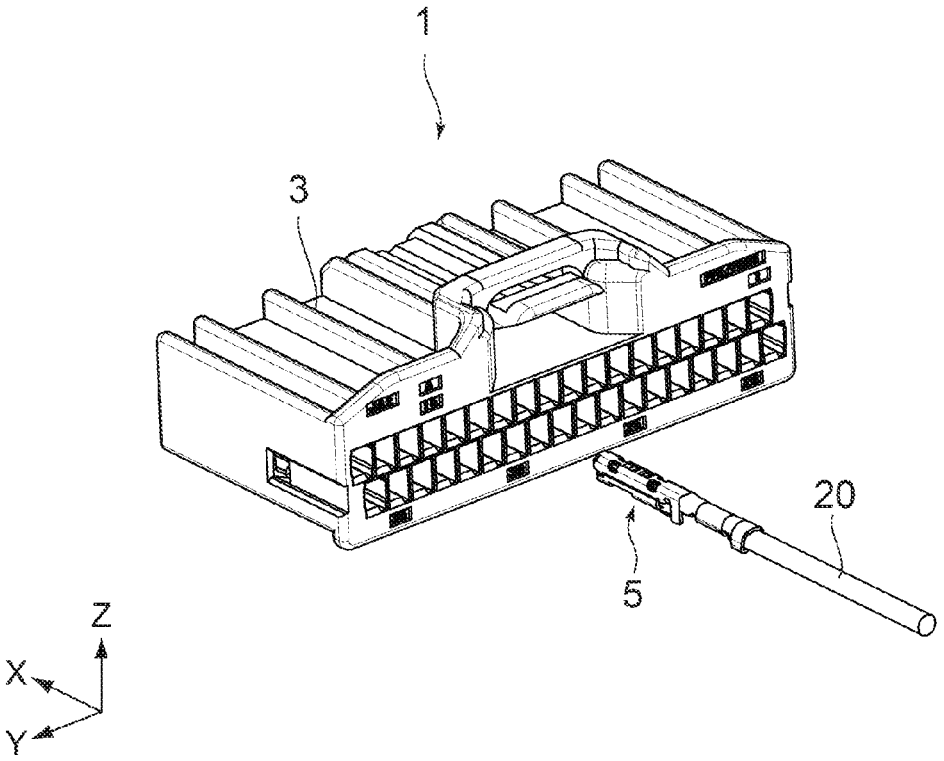
FIG. 2 is an exploded, perspective view showing the connector of FIG. 1.
Figure 3:
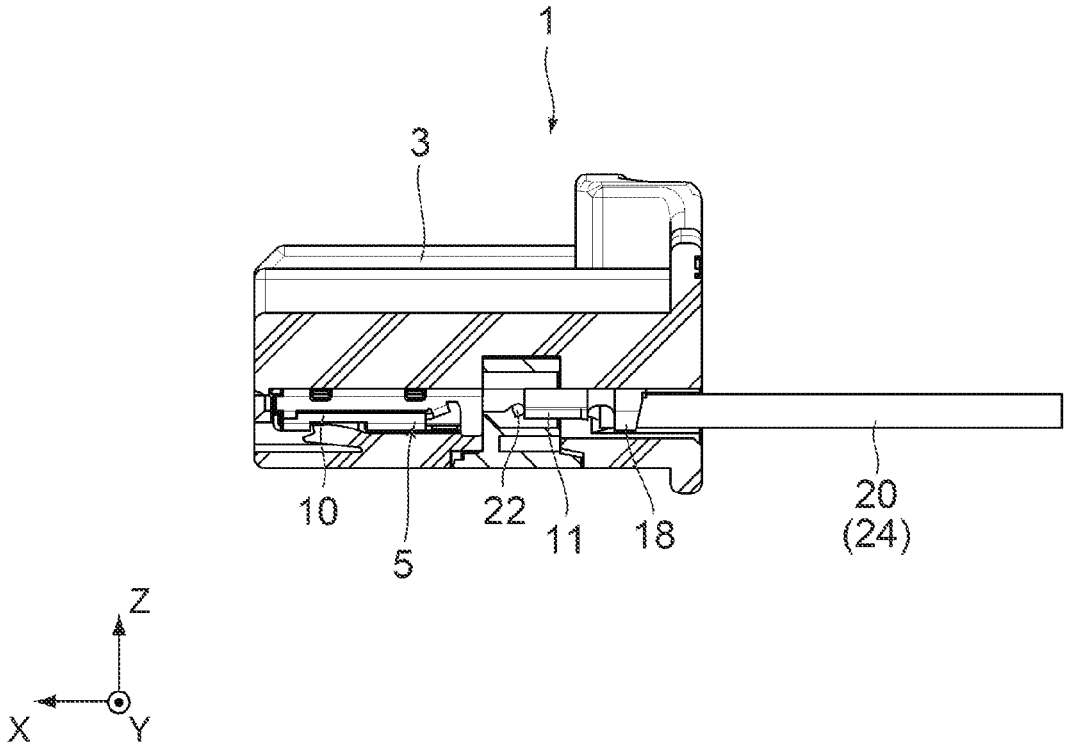
FIG. 3 is a cross-sectional view showing the connector of FIG. 1, taken along line III-III.
Figure 4:
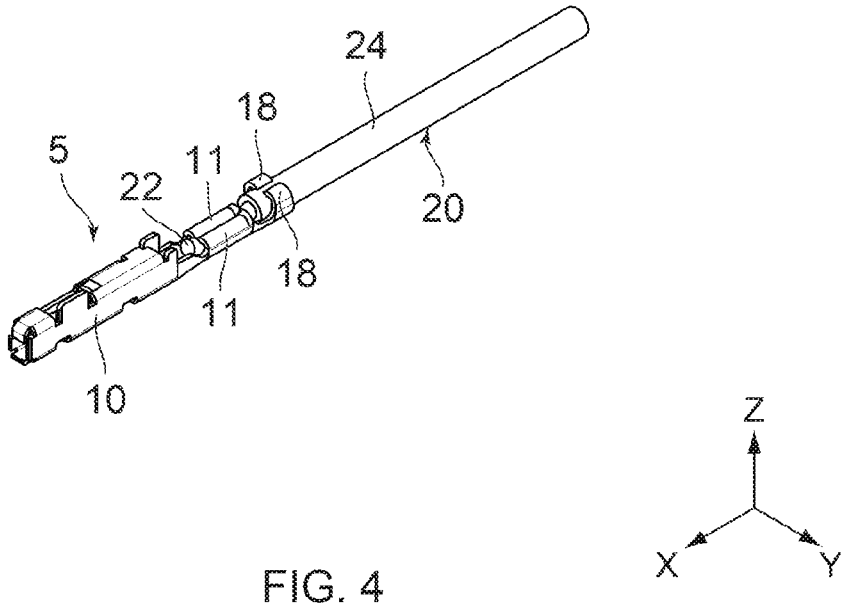
FIG. 4 is a perspective view showing a crimp terminal which is included in the connector of FIG. 2. The crimp terminal is connected to a cable.

Referring to FIGS. 1 to 3, a connector 1 according to an embodiment of the present invention comprises a holder 3 made of insulator and a crimp terminal 5 made of conductor. The holder 3 holds the crimp terminal 5. Although the connector 1 comprises a plurality of the crimp terminals 5, only one of the crimp terminals 5 is illustrated in FIGS. 1 to 3. To the crimp terminal 5, a cable 20 is connected. As shown in FIG. 4, the cable 20 comprises a conductive core 22 made of conductor and an outer insulator 24 made of insulator. The outer insulator 24 covers the conductive core 22. Although the conductive core 22 of the cable 20 according to the present embodiment is made of aluminum or aluminum alloy, the present invention is not limited thereto. The conductive core 22 may be made of other metal.

Figure 5:
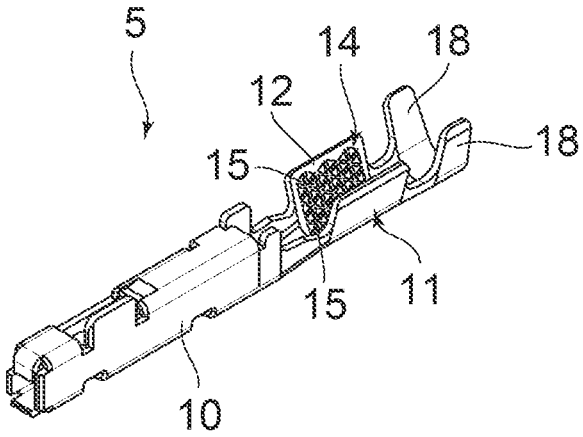
FIG. 5 is another perspective view showing the crimp terminal of FIG. 4. The crimp terminal is not yet connected to the cable.
Figure 5:
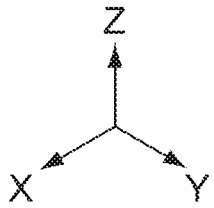

As shown in FIGS. 4 and 5, the crimp terminal 5 is obtained by bending a metal piece which is punched out from a metal sheet. The illustrated crimp terminal 5 includes a socket portion 10, a crimp barrel 11 and a cable holder 18. The socket portion 10 is connected to a mating contact (not shown) of a mating connector (not shown). The crimp barrel 11 is crimped around the conductive core 22 of the cable 20. The cable holder 18 is crimped around the outer insulator 24 of the cable 20 to hold the cable 20. As understood from FIGS. 4 and 5, the conductive core 22 of the cable 20 is disposed on the inner surface 12 of the crimp barrel 11 to extend in the X-direction (predetermined direction), and the crimp barrel 11 is then crimped around the conductive core 22, so that the crimp terminal 5 is connected to the cable 20.

Figure 6:
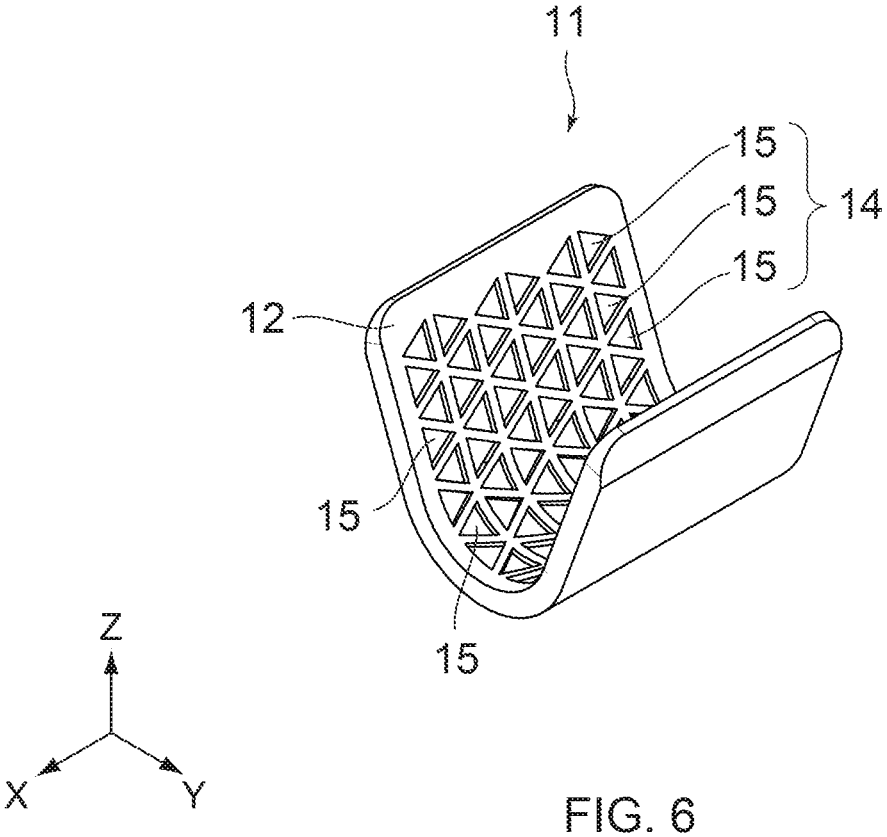
FIG. 6 is a schematic perspective view showing only a crimp barrel of the crimp terminal.

As shown in FIGS. 5 and 6, the crimp barrel 11 includes an inner surface 12 which is formed with serrations 14 having a plurality of cavities 15 independent of one another. The cavities 15 increase frictional resistance between a contact surface of the conductive core 22 (electrical wire) and the inner surface 12 when the crimp barrel 11 is crimped. The cavities 15 are effective in suppressing a decrease in a thickness of the conductive core 22 in the crimp barrel 11 by a plastic flow thereof. The cavities 15 suppress an elongation of the conductive core 22 when the crimp barrel 11 is crimped. Thus, a decrease of crimping strength of the crimp barrel 11 can be suppressed so that electrical connection performance of the crimp terminal 5 can be stably maintained.

Each of the cavities 15 of the serrations 14 according to the present embodiment have a predetermined shape in a plane perpendicular to a depth direction of the cavity 15 (i.e. in a plane perpendicular to a thickness direction of a metal plate constituting the crimp terminal 5). The predetermined shape satisfies the following three conditions: [condition 1] the predetermined shape contains a plurality of straight-line segments as components of the predetermined shape; [condition 2] every one of the straight-line segments of the predetermined shape is not parallel with remaining ones of the straight-line segments of the predetermined shape; and [condition 3] the straight-line segments of the predetermined shape includes at least one pair of the straight-line segments, which are closest to each other among the straight-line segments of the predetermined shape and are arranged to make an interior angle less than 90 degrees or, if not intersecting each other, are arranged on two straight lines, respectively, wherein the two straight lines make an interior angle less than 90 degrees.

The condition 1 is satisfied in a case where the predetermined shape contains only a plurality of straight-line segments (i.e. in a case where the predetermined shape is a polygon). In addition, the condition 1 is satisfied in a case where the predetermined is a shape containing a part in which two straight-line segments closest to each other among the straight-line segments of the predetermined shape are connected through a short curved-line segment or a short non-straight line segment. The shape containing the part is, for example, obtained by chamfering or rounding corners of the polygon. The predetermined shape satisfying the condition 1 essentially contains the straight-line segments so that it is easy to form a stamping die for use in shaping the serrations 14.

The condition 2 excludes, from the predetermined shape, a shape which contains at least one pair of the straight-line segments parallel to each other, such as a parallelogram, trapezoid or rhombus. For example, if each of cavities of serrations of a crimp terminal has a shape of a parallelogram in a plane perpendicular to a depth direction of the cavity as in the crimp terminal of JPB 4979147, a conductive core might be moved along parallel straight-line segments in the cavity after crimping so that the conductive core might be oxidized again. On the contrary, if the predetermined shape satisfies the condition 2, such reoxidation can be prevented.

The condition 3 is satisfied in a case where the predetermined shape includes at least one interior angle less than 90 degrees if the predetermined shape is the polygon. Alternately, the condition 3 is satisfied in a case where the straight-line segments of the predetermined shape include at least one pair of the straight-line segments, which are closest to each other among the straight-line segments of the predetermined shape and are arranged on two straight lines, respectively, wherein the two straight lines make an interior angle less than 90 degrees if the predetermined shape is, for example, obtained by chamfering or rounding corners of the polygon. In other words, the condition 3 is a requirement in which the predetermined shape includes a portion having an acute angle or a portion similar thereto. If a thermal expansion coefficient of metal constituting the crimp terminal 5 is different from a thermal expansion coefficient of metal constituting the conductive core 22, a gap might occur between the crimp terminal 5 and the conductive core 22 due to peripheral temperature change. If the predetermined shape includes a portion having an acute angle or a portion similar thereto, a part of the conductive core 22, which is held in the cavity 15 by crimping the crimp barrel 11, hardly comes off from the cavity 15. In other words, even if the crimp terminal 5 is used under an environment with temperature change, the conductive core 22 is prevented from coming off the cavities 15 and from being reoxidized. Therefore, even if thermal expansion or shrinkage occurs in the crimp terminal 5 or the conductive core 22, deterioration of a contact resistance therebetween hardly occurs.

Figure 7:
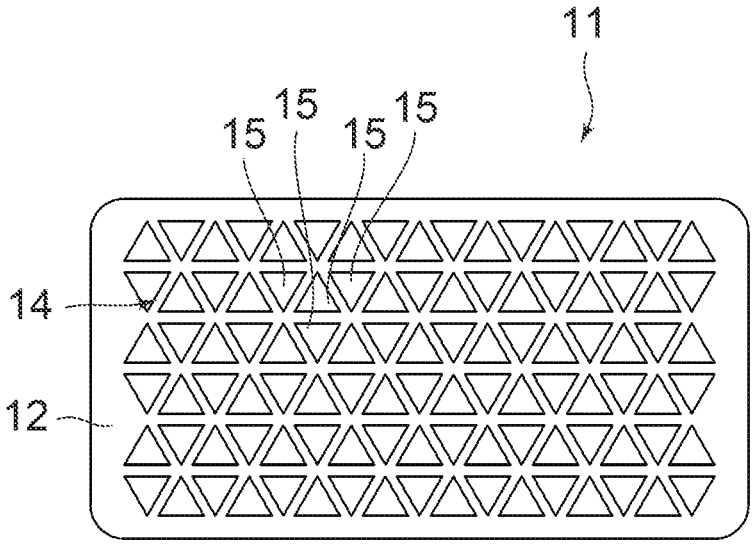
FIG. 7 is a plan view showing a state where the crimp barrel of FIG. 6 is opened to have a flat shape.

As shown in FIGS. 6 and 7, each of the predetermined shapes of the cavities 15 according to the present embodiment is a regular triangle. The cavities 15 have structures same as each other. However, the present invention is not limited thereto. If the above-described conditions of the predetermined shapes are satisfied, each of the predetermined shapes may be a triangle other than the regular triangle, a polygon or the like other than the triangle, or a shape which is obtained by chamfering or rounding corners of the triangle other than the regular triangle or the polygon other than the triangle. In addition, one of the cavities 15 may have different structures (shapes and sizes) from remaining ones of the cavities 15. For example, the serrations 14 may have multiple kinds of cavities 15.

In detail, before the crimp barrel 11 according to the present embodiment is crimped, the predetermined shape of one of the cavities 15 of the serrations 14 is not translational symmetric with the predetermined shapes of three other ones of the cavities 15 which are arranged closest to three sides of the triangle of the predetermined shape of the one cavity 15. In other words, even if the predetermined shape of one of the cavities 15 is moved in parallel, the predetermined shape of one of the cavities 15 does not match any one of the predetermined shapes of three other ones of the cavities 15, each of which has a side adjacent to one of the three sides of the triangle of the predetermined shape of the one cavity 15. Especially, in the present embodiment, each of the predetermined shapes (regular triangle) of the three other cavities 15 is translational symmetric with a shape which is obtained by rotating the predetermined shape (regular triangle) of the one cavity 15 by 60 degrees.

By the above-described arrangement, every one of the straight-line segments of the predetermined shape (regular triangle) intersects with the X-direction (predetermined direction). As mentioned above, the conductive core 22 is pressed and deformed to extend outward in the X-direction from the inside of the crimp barrel 11 when the crimp barrel 11 is crimped. Since every one of the straight-line segments of the predetermined shape intersects with the X-direction, the conductive core 22 can be suppressed to be moved outward from the inside of the crimp barrel 11. Accordingly, sufficient amount of the conductive core 22 can be remained in the crimp barrel 11 after crimping. A similar effect can also be obtained by an arrangement which is other than the above-described arrangement and provides that the predetermined shapes are arranged so that every one of the straight-line segments of the predetermined shapes intersects with the X-direction (predetermined direction).

Figure 8:
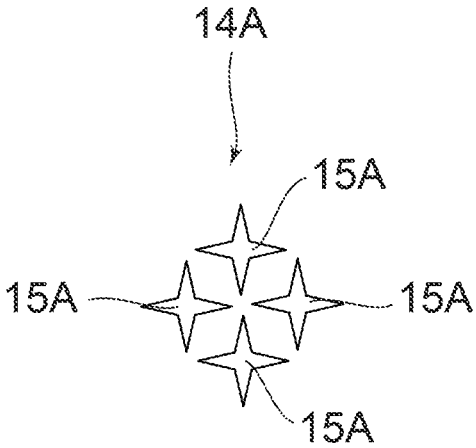
FIG. 8 is a view showing a modification of serrations.
Figure 9:
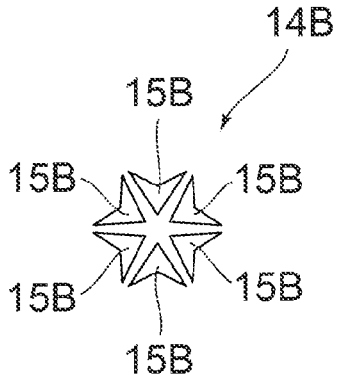
FIG. 9 is a view showing another modification of the serrations.

The predetermined shape is not limited to the triangle. The predetermined shape may be a convex polygon that includes at least one interior angle less than 90 degrees, or a concave polygon that includes at least one interior angle less than 90 degrees and at least one interior angle greater than 180 degrees. For example, serrations 14A of a modification shown in FIG. 8 have a plurality of cavities 15A. A shape of each cavity 15A satisfies the above-described requirement of the predetermined shape. In detail, the predetermined shapes of each cavity 15A is a specific cross-shape which includes four interior angles each less than 90 degrees and four interior angles each greater than 180 degrees. Serrations 14B of another modification shown in FIG. 9 have a plurality of cavities 15B. A shape of each cavity 15B also satisfies the above-described requirement of the predetermined shape. In detail, each of the predetermined shapes of the cavities 15B is a V-like shape which includes one interior angle greater than 180 degrees and three interior angles each less than 90 degrees.

Figure 10:
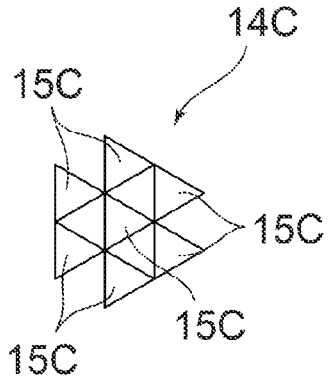
FIG. 10 is a view showing yet another modification of the serrations.

Referring to FIG. 10, although the predetermined shape of cavities 15C of serrations 14C according to yet another modification is a regular triangle and is same as the predetermined shape of the above-described embodiment, an arrangement of the cavities 15C is different from the arrangement of the above-described embodiment. In detail, according to the present modification, the predetermined shape of one of the cavities 15C is translational symmetric with the predetermined shapes of other ones of the cavities 15C which are arranged closest to the predetermined shape of the one cavity 15C. If the cavities 15C are arranged so that every one of the straight-line segments of the predetermined shapes (regular triangle) intersects with the X-direction (predetermined direction), sufficient amount of the conductive core 22 can be remained in the crimp barrel 11 after crimping. However, the number of the cavities 15C per a unit region is less than the number of the cavities 15 per a unit region according to the above-described embodiment. Thus, in order to increase the number of the cavities per a unit region, the arrangement of the above-described embodiment is preferable. In addition, from a viewpoint of a facility of a formation of a stamping die for use in shaping the serrations 14C, the serrations 14 of the above-described embodiment are preferable.

Figure 11:
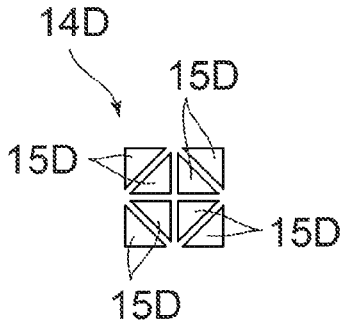
FIG. 11 is a view showing still another modification of the serrations.
Figure 12:
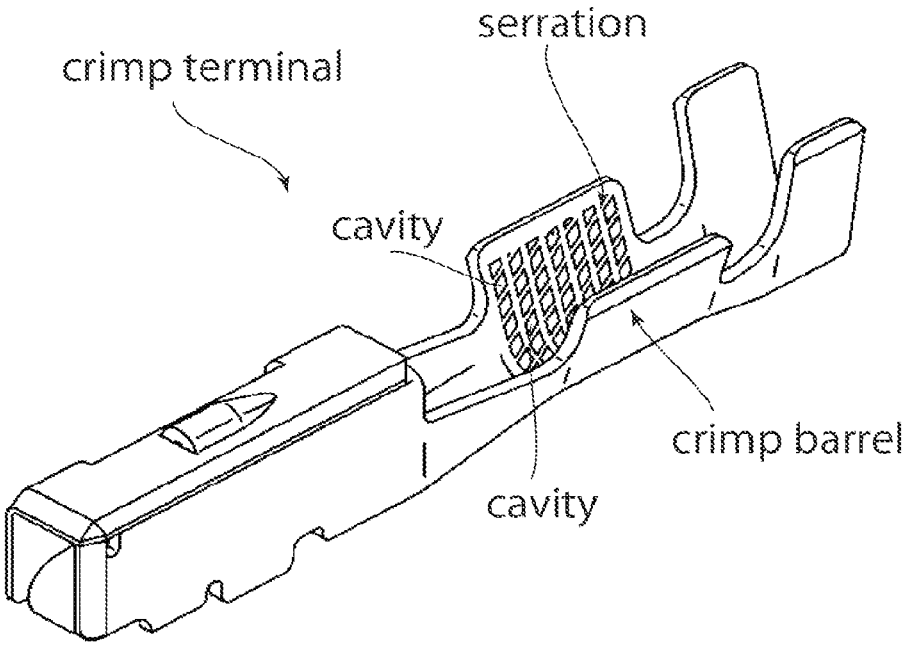
FIG. 12 (PRIOR ART)
FIG. 12 is a perspective view showing a crimp terminal of JPB 4979147.
Figure 13:
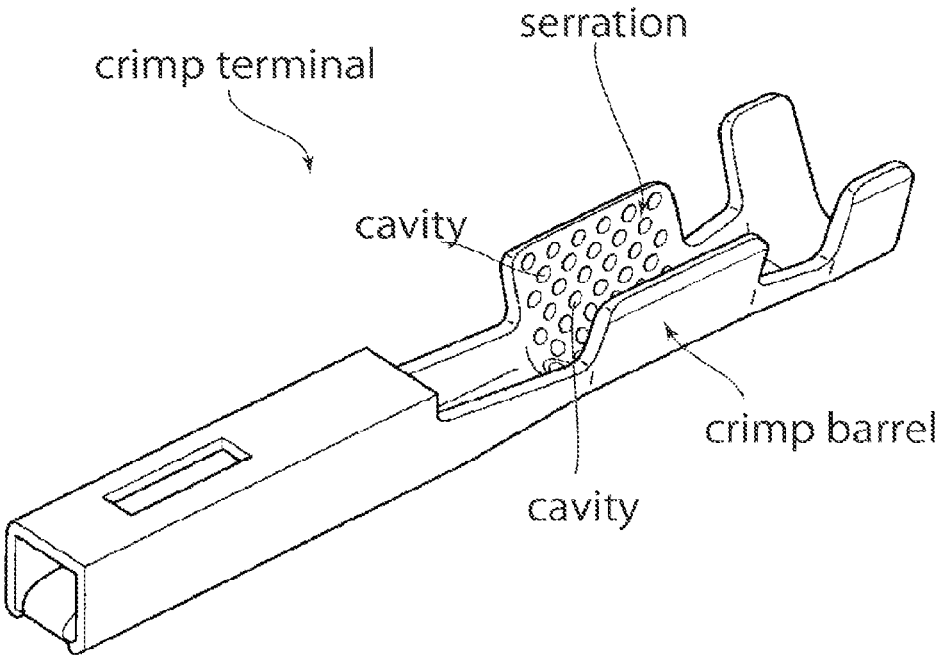
FIG. 13 (PRIOR ART)
FIG. 13 is a perspective view showing a crimp terminal of JPA 2012-38453.

Referring to FIG. 11, each of the predetermined shapes of cavities 15D of serrations 14D according to still another modification is a triangle other than a regular triangle. Specifically, the predetermined shape of the still another modification is a isosceles right triangle. In this case, the shape of each cavity 15D satisfies the above-described requirement of the predetermined shape.

Although the present invention has been described with specific examples, the present invention is not limited thereto. Various modifications and applications are possible with the present invention. For example, although the crimp terminal 5 of the above-described embodiment has the socket portion 10, the present invention is not limited to the above-described embodiment. For example, the crimp terminal 5 may have a flat type blade or an annular connection portion, instead of the socket portion 10.

The present application is based on a Japanese patent application of JP2013-246191 filed before the Japan Patent Office on Nov. 28, 2013, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A crimp terminal including a crimp barrel to be crimped around a conductive core of a cable, wherein:

the crimp barrel includes an inner surface which is formed with a plurality of cavities independent of one another;

each of the cavities has a single predetermined shape in a plane perpendicular to a depth direction of the cavity;

the predetermined shape contains a plurality of straight-line segments;

every one of the straight-line segments of the predetermined shape is not parallel with remaining ones of the straight-line segments of the predetermined shape; and the straight-line segments of the predetermined shape includes at least one pair of the straight-line segments, which are closest to each other among the straight-line segments of the predetermined shape and are arranged to make an interior angle less than 90 degrees or, if not intersecting each other, are arranged on two straight lines, respectively, the two straight lines making an interior angle less than 90 degrees.

2. The crimp terminal as recited in claim 1, wherein the predetermined shape is a polygon.

3. The crimp terminal as recited in claim 2, wherein the predetermined shape is a concave polygon which includes at least one interior angle greater than 180 degrees.

4. The crimp terminal as recited in claim 1, wherein the predetermined shape is a triangle.

5. The crimp terminal as recited in claim 4, wherein the cavities have structures same as each other.

6. The crimp terminal as recited in claim 5, wherein, before the crimp barrel is crimped, the predetermined shape of one of the cavities is not translational symmetric with the predetermined shapes of three other ones of the cavities which are arranged closest to three sides of the triangle of the predetermined shape of the one cavity.

7. The crimp terminal as recited in claim 6, wherein:

the predetermined shape is a regular triangle;

each of the predetermined shapes of the three other cavities is translational symmetric with a shape which is obtained by rotating the predetermined shape of the one cavity by 60 degrees.

8. The crimp terminal as recited in claim 1, wherein:

the crimp terminal is connected when the crimp barrel is crimped around the conductive core of the cable which is disposed on the inner surface of the crimp barrel and which extends in a predetermined direction; and every one of the straight-line segments of the predetermined shape intersects with the predetermined direction.

9. The crimp terminal as recited in claim 1, wherein the conductive core is made of aluminum or aluminum alloy.

10. A connector comprising the crimp terminal as recited in claim 1 and a holder holding the crimp terminal.

* * * * *